US005735455A

United States Patent [19]

Raniere, Sr.

[11] Patent Number: 5,735,455

[45] Date of Patent: Apr. 7, 1998

[54] EASILY ERECTABLE ONE-PIECE CONTAINER WITH ATTACHMENT MEANS AND BLANK THEREFOR

[76] Inventor: John E. Raniere, Sr., 1995 Farrell, Park Ridge, Ill. 60068

[21] Appl. No.: 693,404

[22] Filed: Aug. 7, 1996

[51] Int. Cl.[6] ..... B65D 25/20

[52] U.S. Cl. ..... 229/185; 206/425; 206/818; 220/483; 248/206.5

[58] Field of Search ..... 206/818, 425; 220/483; 229/185; 248/206.5, 311.2

[56] References Cited

U.S. PATENT DOCUMENTS

| | | | |
|---|---|---|---|
| 3,374,937 | 3/1968 | Wilson | 229/185 |
| 4,100,684 | 7/1978 | Berger | 248/206.5 |
| 4,660,715 | 4/1987 | Anastos | 206/818 |
| 4,709,852 | 12/1987 | Stoll | 229/185 |
| 4,736,853 | 4/1988 | O'Mara . | |
| 4,790,474 | 12/1988 | Mitsuyama . | |
| 5,170,889 | 12/1992 | Cue . | |
| 5,351,813 | 10/1994 | Golovan . | |
| 5,367,278 | 11/1994 | Yoshikawa | 206/818 |
| 5,490,607 | 2/1996 | Hsieh et al. | 220/483 |
| 5,598,923 | 2/1997 | Owens | 206/818 |

FOREIGN PATENT DOCUMENTS

| | | | |
|---|---|---|---|
| 5-139448 | 6/1993 | Japan | 220/483 |
| 948037 | 2/1961 | United Kingdom | 220/483 |

*Primary Examiner*—Jimmy G. Foster

*Attorney, Agent, or Firm*—Polster, Lieder, Woodruff & Lucchesi, L.C.

[57] ABSTRACT

An open top container for attachment to an upright metallic surface having a one-piece body and magnetic tape on the back panel, interlocking flaps forming the bottom panel, and an adhesive coated tab securing the body in assembled relation. The blank for forming the one-piece body also is disclosed.

2 Claims, 1 Drawing Sheet

EASILY ERECTABLE ONE-PIECE CONTAINER WITH ATTACHMENT MEANS AND BLANK THEREFOR

BACKGROUND OF THE INVENTION

This invention relates to a device for holding coupons, and the like, in a readily available location such as on a refrigerator door. Specifically, the invention relates to a one-piece device which is manufactured and sold in a flat condition and which can be erected by the user into a rectangular open-top receptacle for attachment to a flat surface such as a refrigerator door. The invention also relates to a blank for making such coupon holder and to a magnetized tape attached to the perimeter of the back panel of said holder for attaching the holder to a metal surface.

A wide variety of holding apparatus that are attachable to some type of vertical surface, such as a refrigerator door or the like, are known. However, these known products lack a number of convenient features such as being sold to the user in flat form for easy erection into a finished product.

For instance, U.S. Pat. No. 4,736,853 to O'Mara discloses a flexible magnetized holder with pockets for accessories such as note pads, books, pens, tissues, or the like, which allows for placement on and removal from ferro-magnetic surfaces such as locker doors and refrigerator doors. The material forming the pockets of O'Mara, however, is generally opaque and is sewn or glued to the base.

U.S. Pat. No. 5,351,813 to Golovan shows a storage apparatus with numerous detachable compartments attached to a base member which, in turn, is fastened to a flat surface.

U.S. Pat. No. 5,170,889 to Cue shows a folding wallet for holding coupons which can be attached to a hook.

None of the foregoing shows a one-piece blank which can be erected into a rectangular holder which can be assembled by the user and has means for easily attaching it to a metallic upright surface.

SUMMARY OF THE INVENTION

An object of the present invention is to provide a one-piece receptacle for attachment to a surface disposed generally in a vertical plane, said receptacle being sold as a package in a flat condition and easily erected by the user into an open-top receptacle.

The present invention also comprises a die cut blank which has an adhesive side flap and interlocking bottom flaps for erection of the blank into an open top one-piece coupon receptacle. The blank also has magnetic tape on the back panel allowing attachment to a metallic surface.

The present device also can be easily collapsed into a flat storage condition by disengagement of the bottom panel flaps.

These and other objects and advantages will become apparent hereinafter. Also, further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

In the drawings wherein like parts refer to like numbers wherever they occur.

DETAILED DESCRIPTION

Figure 1:
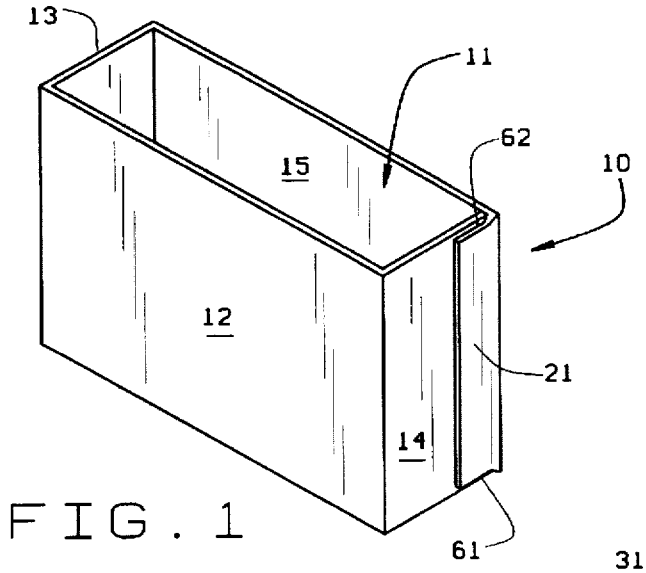
FIG. 1 is a top perspective view of the erected receptacle.
Figure 2:
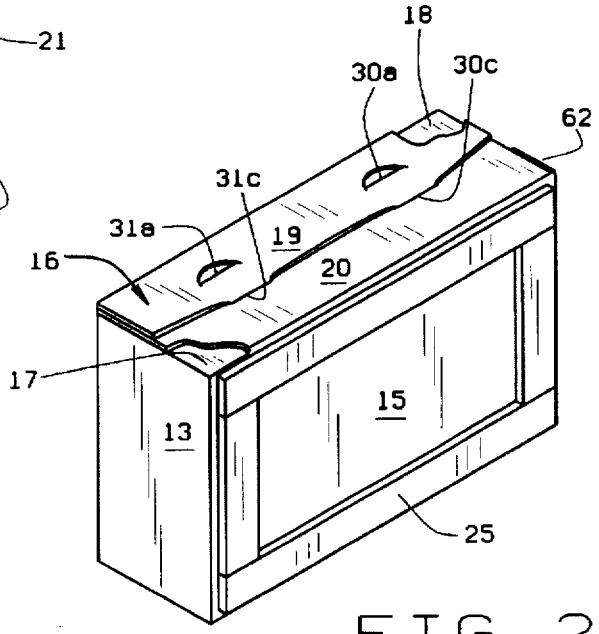
FIG. 2 is a bottom back perspective of the invention.
Figure 3:
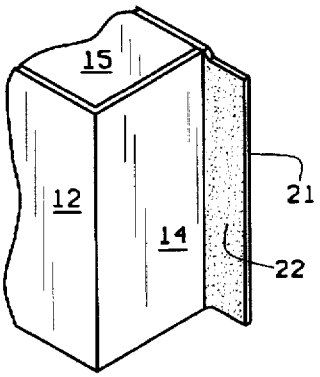
FIG. 3 is a fragmentary perspective view showing a corner of the receptacle before the adhesive flap is attached.

FIGS. 1 and 2 show the receptacle 10 in erected and assembled condition. The receptacle has an open top generally indicated by the number 11. The top is defined by the top edges of a front panel 12, a first end panel 13, a second end panel 14 and a back panel 15.

The bottom 16 is formed from a series of interlocking and reinforcing flaps which are hingedly connected to the front panel 12, the side panels 13,14 and the back panel 15. In particular, the end panels 13 and 14 have bottom flaps 17 and 18 respectively hingedly connected thereto. The front panel 12 has a bottom flap 19 hingedly connected thereto and the back panel 15 has the bottom flap 20 hingedly connected thereto. The flaps 17,18,19,20, when folded toward each other and interlocked (as will be explained in detail hereinafter) form the bottom panel 16.

Figure 5:
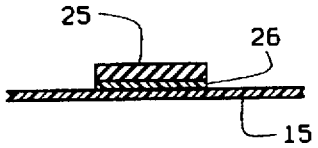
FIG. 5 is a fragmentary sectional view taken along line 5—5 of FIG. 4.

Attached to the outside of the back panel 15 are magnetic strips 25 around the periphery. The strips 25 have an adhesive backing 26 by which they are attached to the back panel 15. This is shown in FIG. 5.

An end flap 21 on the back panel 15 has an adhesive coating 22 which allows it to be secured to the opposite side panel 14 to retain the receptacle 10 in its erected assembled rectangular configuration.

The bottom 16 is formed by interlocking the bottom flaps 17,18,19,20. The back panel bottom flap 20 has two rectangular cut-outs 30,31.

The cut-out 30 is defined by longitudinal edges 30*a*,30*c* and lateral edges 30*b*,30*d*. The cut-out 31 is defined by longitudinal edges 31*a*,31*c* and lateral edges 31*b*,31*d*.

Aligned with the cut-outs 30,31 are corresponding tabs 32,32*a* and 33,33*a* on the front panel bottom flap 19.

When the bottom 16 is formed as the receptacle 10 is assembled, the end panel flaps 17,18 are folded toward each other, the back panel flap 20 is folded over the panel flaps 17,18 and the front panel flap 19 is folded over the back panel flap 20. The tabs 33,33*c* are engaged with the opening 30 by sliding the tab 33 under the edge 30*a* and the tab 33*a* under the edge 30*c* and the tab 32 is positioned under the edge 30*a* and the tab 32*a* is positioned under the edge 30*c*. This locks the flaps 20 and 19 together and forms a solid bottom with the flaps 17,18.

Figure 4:
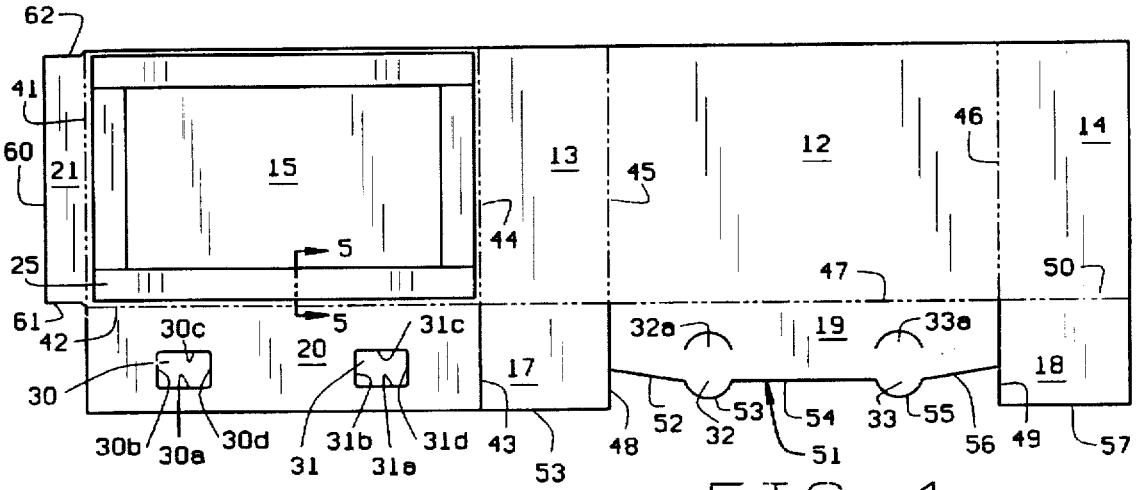
FIG. 4 is a plan view of the blank from which the receptacle is formed.

FIG. 4 shows the blank 40 from which the receptacle 10 is formed. The blank 40 includes the back panel 15 and the back panel end flap 22 which is connected thereto by a score line 41. It also includes the back panel bottom flap 20 which is connected to the back panel 15 by a score line 42. The cut-outs 30,31 are formed in the back panel bottom flap 20. A cut line of separation 43 separates the back panel bottom flap 20 from the adjacent first end panel bottom flap 17. A score line 44 connects the back panel 15 to the first end panel 13.

The front panel 12 is connected to the first end panel 13 by a score line 45 and to the second end panel 14 by a score line 46. The front panel end flap 19 is connected to the front panel 12 by the fold line 47 and is separated from the adjacent first end panel bottom flap 17 by a cut line 48 and from the adjacent second end panel bottom flap 18 by a cut line 49. The second end panel bottom flap 18 is connected to the second end panel 14 by a score line 50.

The front panel bottom flap 19 has an irregular free edge 51 which includes a first segment 52 which begins at the cut 48 below the first end panel edge 53. The segment 52 inclines upwardly away from the first end panel flap 17 to the tab 32. The tab 32 has a semi-circular margin 53. The edge 51 continues in a straight edge 54 to the second tab 33 which also has a semi-circular edge 55. A terminating segment 56 inclines downwardly to the cut 49 below the outer margin 57 of the second end panel bottom flap 18.

The glue tab 21 has an outer margin defined by the free edge 60 which is connected to the back panel 15 by edges 61,62 which are spaced inwardly from the fold line 42 and the free edge 63 of the back panel 15 respectively. This allows the glue tab 21 to engage the second end panel 14 without interference.

This invention is intended to cover all changes and modifications of the example of the invention herein chosen for purposes of the disclosure which do not constitute departures from the spirit and scope of the invention.

What is claimed is:

1. A receptacle for attachment to an upright metallic surface comprising front, bottom, back and first and second side panels assembled to define a rectangular open top receptacle, a) both of the side panels being rectangular and having bottom flaps hingedly connected thereto, b) the back panel being rectangular and having a bottom flap hingedly connected to one edge and a glue flap hingedly connected to an adjacent second edge, the back panel being hingedly connected to the first side panel, the bottom flap having opposed cut-out areas therein, c) the front panel being rectangular and having a hingedly connected bottom flap, the front panel being hingedly connected to both of the side panels, the bottom flap having opposed sets of tabs aligned with the cut-out areas of the back panel bottom flap, d) the bottom panel defined by the said bottom flaps folded toward each other with the front panel bottom flap tabs engaged with the back panel bottom flap cut-outs;

e) the back panel glue flap being adhesively secured to the second side panel, and f) magnetic tape secured to the outer surface of the back panel.

2. A blank for a rectangular receptacle for attachment to an upright metallic surface comprising front, bottom, back and first and second side panels, a) both of the side panels being rectangular and having bottom flaps connected thereto by a score line, b) the back panel being rectangular and having a bottom flap connected to one edge by score line and a glue flap connected to an adjacent second edge by a score line, the back panel being connected to a first side panel by a score line, the bottom flap having opposed cut-out areas therein, c) the front panel being rectangular and having a bottom flap connected to one edge by a score line, said bottom flap having a free edge, the front panel being connected to both of the side panels by score lines, the bottom flap having spaced apart tabs on the free edge and arcuate cuts in the flap opposite the tabs, the tabs and cuts being aligned with the cut-out areas of the back panel bottom flap when the blank is erected into a rectangular shape, and d) magnetic tape secured to the outer surface of the back panel around the edges thereof.

* * * * *